US006996529B1

(12) United States Patent
Minnis

(10) Patent No.: US 6,996,529 B1
(45) Date of Patent: Feb. 7, 2006

(54) SPEECH SYNTHESIS WITH PROSODIC PHRASE BOUNDARY INFORMATION

(75) Inventor: Stephen Minnis, Ipswich (GB)

(73) Assignee: British Telecommunications public limited company, London (GB)

( * ) Notice: Subject to any disclaimer, the term of this patent is extended or adjusted under 35 U.S.C. 154(b) by 0 days.

(21) Appl. No.: 09/913,462

(22) PCT Filed: Mar. 8, 2000

(86) PCT No.: PCT/GB00/00854

§ 371 (c)(1),
(2), (4) Date: Aug. 15, 2001

(87) PCT Pub. No.: WO00/55842

PCT Pub. Date: Sep. 21, 2000

(30) Foreign Application Priority Data

Mar. 15, 1999 (GB) ..... 9905904
Jul. 6, 1999 (GB) ..... 99305349

(51) Int. Cl.
*G10L 13/08* (2006.01)

(52) U.S. Cl. ..... 704/258; 704/260

(58) Field of Classification Search ..... 704/258, 704/260, 266, 267, 268, 269
See application file for complete search history.

(56) References Cited

U.S. PATENT DOCUMENTS 5,463,713 A 10/1995 Hasegawa
5,832,435 A 11/1998 Silverman
5,890,117 A * 3/1999 Silverman ..... 704/260
5,913,193 A * 6/1999 Huang et al. ..... 704/258
5,950,162 A * 9/1999 Corrigan et al. ..... 704/260
6,173,262 B1 * 1/2001 Hirschberg ..... 704/260
6,477,495 B1 * 11/2002 Nukaga et al. ..... 704/268
6,665,641 B1 * 12/2003 Coorman et al. ..... 704/260
6,725,199 B2 * 4/2004 Brittan et al. ..... 704/258

FOREIGN PATENT DOCUMENTS

EP 0 821 344 A2 1/1998
EP 0 833 304 A2 4/1998

OTHER PUBLICATIONS

Huang et al., "Whistler: a trainable text-to-speech system," Fourth International Conference on Spoken Language, 1996. ICSLP 96. Proceedings. Oct. 3-6, 1996, vol. 4, pp. 2387 to 2390.*

Veilleux et al., "Markov modeling of prosodic phrase structure," Conference on Acoustics, Speech, and Signal Processing, 1990. ICASSP-90., Apr. 3-6, 1990, vol. 2, pp. 777 to 780.*

(Continued)

*Primary Examiner*—Martin Lerner
(74) *Attorney, Agent, or Firm*—Nixon & Vanderhye P.C.

(57) ABSTRACT

Text-to-speech conversion uses pattern-matching to predict the position of phrase boundaries in spoken output. Text input to the is analyzed to identify groups of words (known as "chunks") which are unlikely to contain internal phrase boundaries. Both the chunks and individual words are labeled with their syntactic characteristics. Access is made to a database of sentences which also contains such syntactic labels, together with indications of where a human reader would insert minor and major phrase boundaries. The parts of the database which have the most similar syntactic characteristics are found and phrase boundaries are predicted based on the phrase boundaries found in those parts. Other characteristics may also be used in the pattern-matching process.

10 Claims, 4 Drawing Sheets

OTHER PUBLICATIONS

Donovan et al., "Phrase splicing and variable substitution using the IBM trainable speech synthesis system," IEEE International Conference on Acoustics, Speech, and Signal Processing, 1999, ICASSP '99., Mar. 15-19, 1999, vol. 1, pp. 373 to 376.*

H.E. Karn, "Design and evaluation of a phonologial phrase parser for Spanish text-to-speech," Fourth International Conference on Spoken Language, ICSLP 96., Oct. 3-6, 1996, vol. 3, pp. 1696 to 1699.*

Sharman et al., "A fast stochastic parser for determining phrase boundaries for text-to-speech synthesis," 1996 IEEE International Conference on Acoustics, Speech, and Signal Processing, ICASSP-96., May 7-10, 1996, vol. 1, pp. 357 to 360.*

Koehn et al., "Improving intonational phrasing with syntactic information," IEEE International Conference on Acoustics, Speech, and Signal Processing, 2000. ICASSP '00, Jun. 5-9, 2000, vol. 3, pp. 1289 to 1290.*

Bachenko et al., "Prosodic phrasing for speech synthesis of written telecommunications by the deaf," Global Telecommunications Conference, 1991. GLOBECOM '91., Dec. 2-5, 1991, vol. 2, pp. 1391 to 1395.*

Fitzpatrick et al., "Parsing for prosody: what a text-to-speech system needs," Proceedings of AI Systems in Government Conference, 1989., Mar. 27-31, 1989, pp. 188 to 194.*

Wang et al, "Predicting International Boundaries Automatically from Text: the ATOS Domain", Proceedings of the Darpa Speech and Natural Language Workshop, Feb. 1991, pp. 378-383.

Zhu et al, "Learning Mappings Between Chinese Isolated Syllables and Syllables in Phrase with Back Propagation Neural Nets", Proceedings of the 1998 Artificial Networks in Engineering Conference, vol. 8, Nov. 1-4, 1998, pp. 723-727.

Kim et al, "Prediction of Prosodic Phrase Boundaries Considering Variable Speaking Rate", International Conference on Spoken Language Processing (ICSLP '96), Oct. 3, 1996, pp. 1505-1508, vol. 3.

* cited by examiner

SPEECH SYNTHESIS WITH PROSODIC PHRASE BOUNDARY INFORMATION

BACKGROUND OF THE INVENTION

1. Field of the Invention

The present invention relates to a method and apparatus for converting text to speech.

2. Related Art

Although text-to-speech conversion apparatus has improved markedly over recent years, the sound of such apparatus reading a piece of text is still distinguishable from the sound of a human reading the same text. One reason for this is that text-to-speech converters occasionally apply phrasing that differs from that which would be applied by a human reader. This makes speech synthesised from text more onerous to listen to than speech read by a human.

The development of methods for predicting the phrasing for an input sentence has, thus far, largely mirrored developments in language processing. Initially, automatic language processing was not available, so early text-to-speech converters relied on punctuation for predicting phrasing. It was found that punctuation only represented the most significant boundaries between phrases, and often did not indicate how the boundary was to be conveyed acoustically. Hence, although this method was simple and reasonably effective, there was still room for improvement. Thereafter, as automatic language processing developed, lexicons which indicated the part-of-speech associated with each word in the input text were used. Associating part-of-speech tags with words in the text increased the complexity of the apparatus without offering a concomitant improvement in the prediction of phrasing. More recently, the possibility of using rules to predict phrase boundaries from the length and syntactic structure of the sentence has been discussed (Bachenko J and Fitzpatrick E: 'A computational grammar of discourse-neutral prosodic phrasing in English', Computational Linguistics, vol. 16, No. 3, pp 155–170 (1990)). Others have proposed deriving statistical parameters from a database of sentences which have natural prosodic phrase boundaries marked (Wang, M. and Hirschberg J: 'Predicting intonational boundaries automatically from text: the ATIS domain', Proc. of the DARPA Speech and Natural Language Workshop, pp 378–383 (February 1991)). These recent approaches to the prediction of phrasing still do not provide entirely satisfactory results.

BRIEF SUMMARY

According to a first aspect of the present invention, there is provided a method of converting text to speech comprising the steps of:

receiving an input word sequence in the form of text;

comparing said input word sequence with each one of a plurality of reference word sequences provided with phrasing information;

identifying one or more reference word sequences which most closely match said input word sequence; and predicting phrasing for a synthesised spoken version of the input text on the basis of the phrasing information included with said one or more most closely matching reference word sequences.

By predicting phrasing on the basis of one or more closely matching reference word sequences, sentences are given a more natural-sounding phrasing than has hitherto been the case.

Preferably, the method involves the matching of syntactic characteristics of words or groups of words. It could instead involve the matching of the words themselves, but that would require a large amount of storage and processing power. Alternatively, the method could compare the role of the words in the sentence—i.e. it could identify words or groups of words as the subject, verb or object of a sentence etc. and then look for one or more reference sentences with a similar pattern of subject, verb, object etc.

Preferably, the method further comprises the step of identifying clusters of words in the input text which are unlikely to include prosodic phrase boundaries. In this case, the reference sentences are further provided with information identifying such clusters of words within them. The comparison step then comprises a plurality of per-cluster comparisons.

By limiting the possible locations of phrase boundary sites to locations between clusters of words, the amount of processing required is lower than would be required were every inter-word location to be considered. Nevertheless, other embodiments are possible in which a per-word comparison is used.

Measures of similarity between the input clusters and reference clusters which might be used include:

a) measures of similarity in the syntactic characteristics of the input cluster and the reference cluster;

b) measures of similarity in the syntactic characteristics of the words in the input cluster and the words in the reference cluster; and c) measures of similarity in the number of words or syllables in the input cluster and the reference cluster;

d) measures of similarity in the role (e.g. subject, verb, object) of the input cluster and the reference cluster;

e) measures of similarity in the role of the words in the input cluster and the reference cluster;

f) measures of similarity in word grouping information, such as the start and end of sentences and paragraphs; and g) measures of similarity in whether new or previously information is being presented in the cluster.

One or a weighted combination of the above measures might be used. Other possible inter-cluster similarity measures will occur to those skilled in the art.

In some embodiments, the comparison comprises measuring the similarity in the positions of prosodic boundaries previously predicted for the input sentence and the positions of the prosodic boundaries in the reference sequences. In a preferred embodiment a weighted combination of all the above measures is used.

According to a second aspect of the present invention, there is provided a text to speech conversion apparatus comprising:

a word sequence store storing a plurality of reference word sequences which are provided with prosodic boundary information;

a program store storing a program;

a processor in communication with said program store and the word sequence store;

means for receiving an input word sequence in the form of text;

wherein said program controls said processor to:

compare said input word sequence with each one of a plurality of said reference word sequences;

identify one or more reference word sequences which most closely match said input word sequence; and derive prosodic boundary information for the input text on the basis of the prosodic boundary information included with said one or more most closely matching reference word sequences.

According to a third aspect of the present invention, there is provided a program storage device readable by a computer, said device embodying computer readable code executable by the computer to perform a method according to the first aspect of the present invention.

According to a fourth aspect of the present invention, there is provided a signal embodying computer executable code for loading into a computer for the performance of the method according to the first aspect of the present invention.

BRIEF DESCRIPTION OF THE DRAWINGS

There now follows, by way of example only, a description of specific embodiments of the present invention. The description is given with reference to the accompanying drawings in which.

DETAILED DESCRIPTION OF EXEMPLARY EMBODIMENTS

Figure 1:
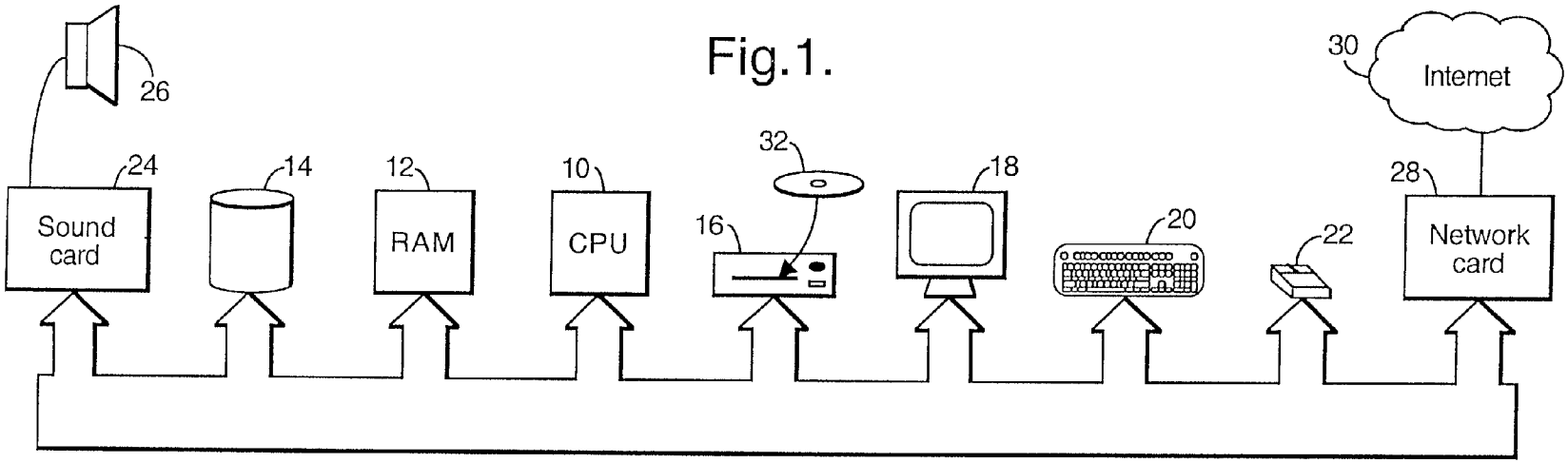
FIG. 1 shows the hardware used in providing a first embodiment of the present invention.

FIG. 1 shows a hardware configuration of a personal computer operable to provide a first embodiment of the present invention. The computer has a central processing unit 10 which is connected by data lines to a Random Access Memory (RAM) 12, a hard disc 14, a CD-ROM drive 16, input/output peripherals 18,20,22 and two interface cards 24,28. The input/output peripherals include a visual display unit 18, a keyboard 20 and a mouse 22. The interface cards comprise a sound card 24 which connects the computer to a loudspeaker 26 and a network card 28 which connects the computer to the Internet 30.

The computer is controlled by conventional operating system software which is transferred from the hard disc 14 to the RAM 12 when the computer is switched on. A CD-ROM 32 carries:

a) software which the computer can execute to provide the user with a text-to-speech facility; and b) five databases used in the text-to-speech conversion process.

To use the software, the user loads the CD-ROM 32 into the CD-ROM drive 16 and then, using the keyboard 20 and the mouse 22, causes the computer to copy the software and databases from the CD-ROM 32 to the hard disc 14. The user can then select a text-representing file (such as an e-mail loaded into the computer from the Internet 30) and run the text-to-speech program to cause the computer to produce a spoken version of the e-mail via the loudspeaker 26. On running the text-to-speech program both the program itself and the databases are loaded into the RAM 12.

Figure 2A:
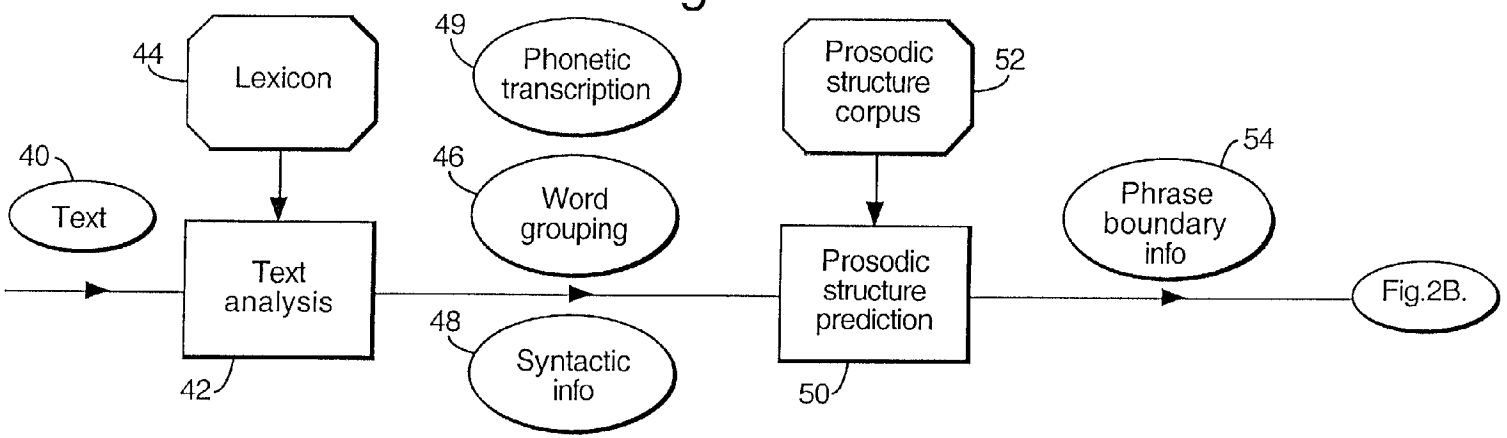
FIGS. 2A and 2B show the top-level design of a text-to-speech conversion program which controls the operation of the hardware shown in FIG. 1.
Figure 2B:
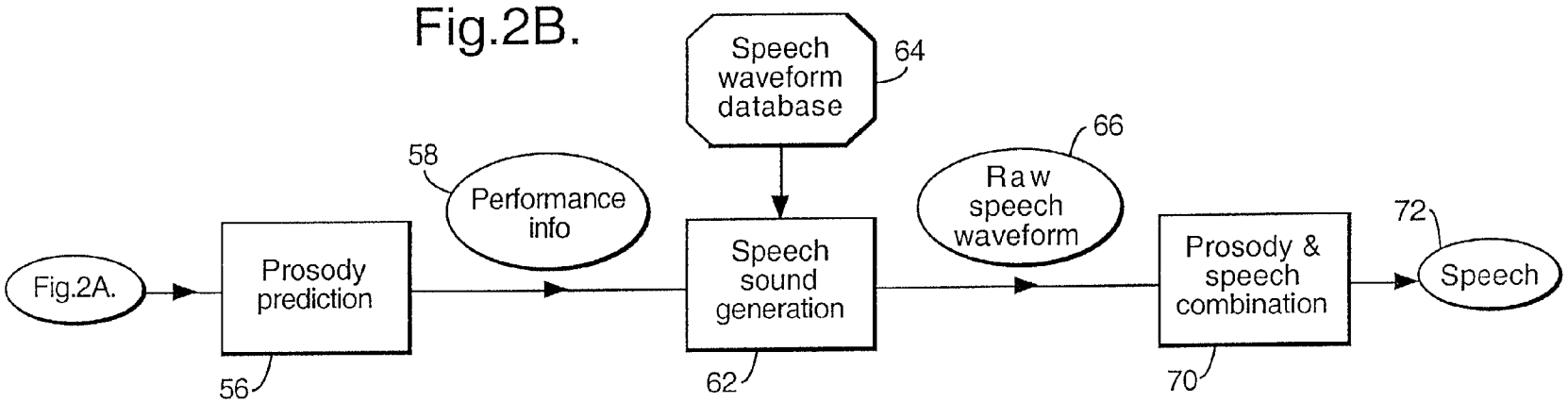

The text-to-speech program then controls the computer to carry out the functions illustrated in FIGS. 2A and 2B. As will be described in more detail below, the computer first carries out text analysis process 42 on the e-mail (shown as text 40) which the user has indicated he wishes to be converted to speech. The text analysis process 42 uses a lexicon 44 (the first of the five databases stored on the CD-ROM 32) to generate word grouping data 46, syntactic information 48 and phonetic transcription data 49 concerning the text-file 40. The output data 46,48,49 is stored in the RAM 12.

After completion of the text analysis program 42, the program controls the computer to carry out the prosodic structure prediction process 50. The process 50 operates on the syntactic data 48 and word grouping data 46 stored in RAM 12 to produce phrase boundary data 54. The phrase boundary data 54 is also stored in RAM 12. The prosodic structure prediction process 50 uses the prosodic structure corpus 52 (which is the second of the five databases stored on the CD-ROM 32). The process will be described in more detail (with reference to FIGS. 4 and 5) below.

Once the phrase boundary data 54 has been generated, the program controls the computer to carry out prosody prediction process (FIG. 2B, 56) to generate performance data 58 which includes data on the pitch, amplitude and duration of phonemes to be used in generating the output speech 72. A description of the prosody prediction process 56 is given in Edgington M et al: 'Overview of current text-to-speech techniques part 2—prosody and speech synthesis', BT Technology Journal, Volume 14, No. 1, pp 84–99 (January 1996). The disclosure of that paper (hereinafter referred to as part 2 of the BTTJ article) is hereby incorporated herein by reference.

Thereafter, the computer performs a speech sound generation process 62 to convert the phonetic transcription data 49 to a raw speech waveform 66. The process 62 involves the concatenation of segments of speech waveforms stored in a speech waveform database 64 (the speech waveform database is the third of the five databases stored on the CD-ROM 32). Suitable methods for carrying out the speech sound generation process 62 are disclosed in the applicant's European patent no. 0 712 529 and European patent application no. 95302474.9. Further details of such methods can be found in part 2 of the BTTJ article.

Thereafter, the computer carries out a prosody and speech combination process 70 to manipulate the raw speech waveform data 66 in accordance with the performance data 58 to produce speech data 72. Again, those skilled in the art will be able to write suitable software to carry out combination process 70. Part 2 of the BTTJ article describes the process 70 in more detail. The program then controls the computer to forward the speech data 72 to the sound card 24 where it is converted to an analogue electrical signal which is used to drive loudspeaker 26 to produce a spoken version of the text file 40.

Figure 3A:
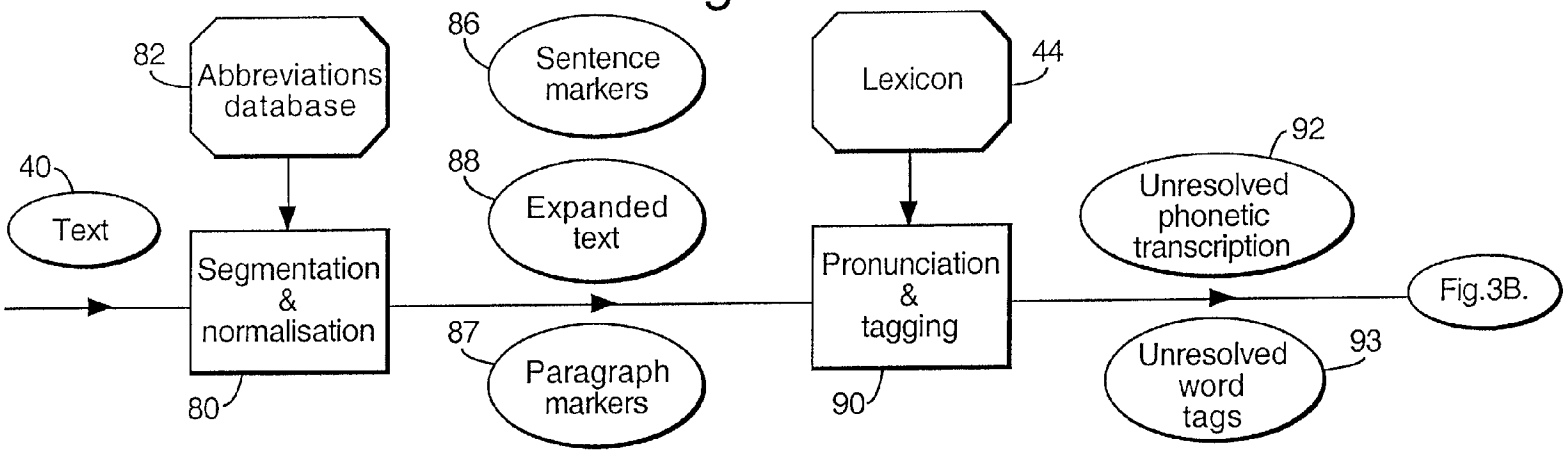
FIGS. 3A & 3B show the text analysis process of FIG. 2A in more detail.
Figure 3B:
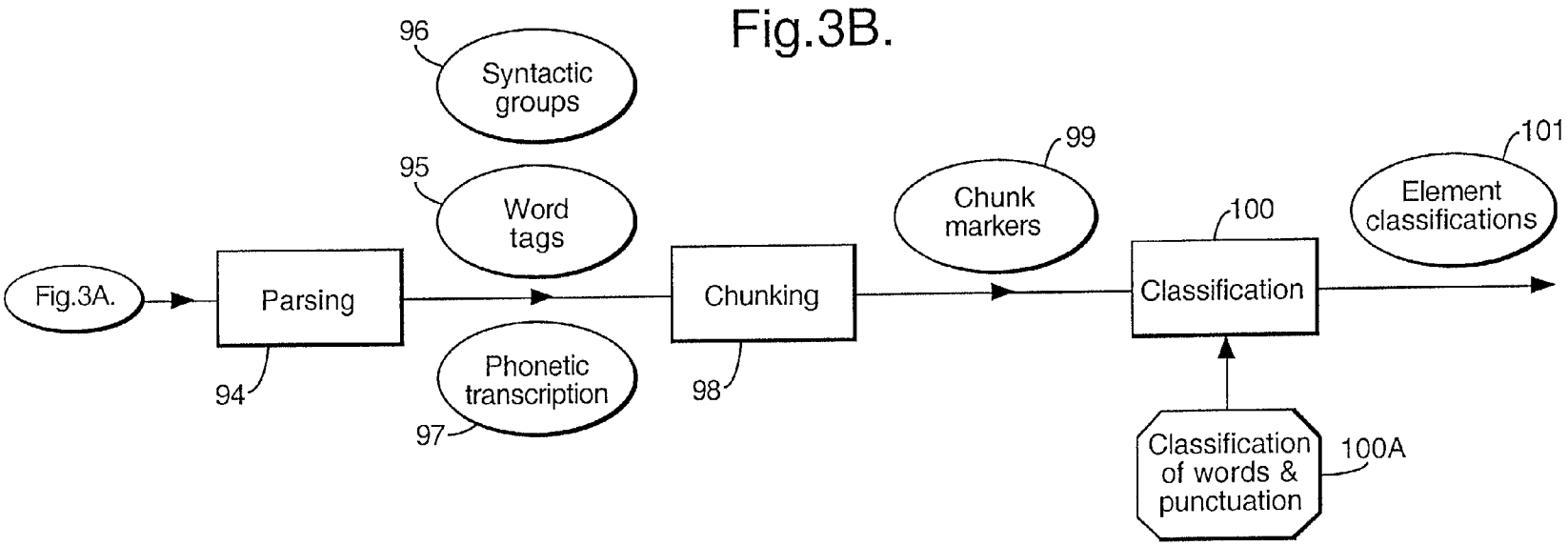

The text analysis process 42 is illustrated in more detail in FIGS. 3A and 3B. The program first controls the computer to execute a segmentation and normalisation process (FIG. 3A, 80). The normalisation aspect of the process 80 involves the expansion of numerals, abbreviations, and amounts of money into the form of words, thereby generating an expanded text file 88. For example, '£100' in the text file 40 is expanded to 'one hundred pounds' in the expanded text file 88. These operations are done with the aid of an abbreviations database 82, which is the fourth of the five databases stored on the CD-ROM 32. The segmentation aspect of the process 80 involves the addition of start-of-sentence, end-of-sentence, start-of-paragraph and end-of-paragraph markers to the text, thereby producing the word grouping data (FIG. 2A: 46) which comprises sentence markers 86 and paragraph markers 87. The segmentation and normalisation process 80 is conventional, a fuller description of it can be found in Edgington M et al: 'Overview of current text-to-speech techniques part 1—'text and linguistic analysis', BT Technology Journal, Volume 14, No. 1, pp 68–83 (January 1996). The disclosure of that paper (hereinafter referred to as part 1 of the BTTJ article) is hereby incorporated herein by reference.

The computer is then controlled by the program to run a pronunciation and tagging process 90 which converts the expanded text file 88 to an unresolved phonetic transcription file 92 and adds tags 93 to words indicating their syntactic characteristics (or a plurality of possible syntactic characteristics). The process 90 makes use of the lexicon 44 which outputs possible word tags 93 and corresponding phonetic transcriptions of input words. The phonetic transcription 92 is unresolved to the extent that some words (e.g. 'live') are pronounced differently when playing different roles in a sentence. Again, the pronunciation process is conventional—more details are to be found in part 1 of the BTTJ article.

The program then causes the computer to run a conventional parsing process 94. A more detailed description of the parsing process can be found in part 1 of the BTTJ article.

The parsing process 94 begins with a stochastic tagging procedure which resolves the syntactic characteristic associated with each one of the words for which the pronunciation and tagging process 90 has given a plurality of possible syntactic characteristics. The unresolved word tags data 93 is thereby turned into word tags data 95. Once that has been done, the correct pronunciation of the word is identified to form phonetic transcription data 97. In a conventional manner, the parsing process 94 then assigns syntactic labels 96 to groups of words.

To give an example, if the sentence 'Similarly Britain became popular after a rumour got about that Mrs Thatcher had declared open house.' were to be input to the text-to-speech synthesiser, then the output from the parsing process 94 would be:

SENTSTART <ADV Similarly_RR ADV>,_, (NR Britain_NP1 NR) [VG became_VVD VG] <ADJ popular_JJ ADJ> [pp after_ICS (NR a_AT1 rumour_NN1 NR) pp] [VG got_VVD about_RP VG] that_CST (NR Mrs_NNSB1 Thatcher_NP1 NR) [VG had_VHD declared_VVN VG] (NR open_JJ house_NNL1 NR) SENTEND ._.

Where SENTSTART and SENTEND represent the sentence markers 86, _RR, _NP1 etc. represent the word tag data 95, and <ADV . . . . . ADV>, (NR . . . . . NR) etc. represent the syntactic groups 96. The meanings of the word tags used in this description will be understood by those skilled in the art—a subset of the word tags used is given in Table 1 below, a full list can be found in Garside, R., Leech, G. and Sampson, G. eds 'The Computation Analysis of English: A Corpus based Approach', Longman (1987).

TABLE 1

| Word Tag | Definition |
|---|---|
| ( ) , - . . . . : ; ? | Punctuation |
| AT1 | singular article: a, every |
| CST | that as conjunction |
| DA1 | singular after-determiner: little, much |
| DDQ | 'wh-' determiner without '-ever': what, which |

TABLE 1-continued

| Word Tag | Definition |
|---|---|
| ICS | preposition-conjunction of time: after, before, since |
| IO | of as preposition |
| JJ | general adjective |
| NN1 | singular common noun: book, girl |
| NNL1 | singular locative noun: island, Street |
| NNS1 | singular titular noun: Mrs, President |
| NP1 | singular proper noun: London, Frederick |
| PPH1 | it |
| RP | prepositional adverb which is also particle |
| RR | general adverb |
| RRQ | non-degree 'wh-adverb' without '-ever': where, when, why |
| TO | infinitive marker to |
| UH | interjection: hello, no |
| VBO | base form be |
| VBDR | imperfective indicative were |
| VBDZ | was |
| VBG | being |
| VBM | am, 'm |
| VBN | been |
| VBR | are, 're |
| VBZ | is, 's |
| VDO | base form do |
| VDD | did |
| VDG | doing |
| VDN | done |
| VDZ | does |
| VHO | base form have |
| VHD | had, 'd (preterite) |
| VVD | lexical verb, preterite: ate, requested |
| VVG | '-ing' present participle of lexical verb: giving |
| VVN | past participle of lexical verb: given |

Next, in chunking process 98, the program controls the computer to label 'chunks' in the input sentence. In the present embodiment, the syntactic groups shown in Table 2 below are identified as chunks.

TABLE 2

| TAG | Description | Example |
|---|---|---|
| IVG | Infinite verb group | [IVG to_TO be_VBO IVG] |
| VG | (non infinite) verb group | [VG was_VBDZ beaten_VVN VG] |
| com | comment phrase | <com Well_UH corn> |
| vpp | verb with prepositional particle | [vpp of_IO \|_\| [VG handling_VVG VG] vpp] |
| pp | prepositional phrase | [pp in_II (NR practice_NN1 NR) pp] |
| NR | noun phrase (non referent) | (NR Dinamo_NP1 Kiev_NP1 NR) |
| R | noun phrase (referent) | (R it_PPH1 R) |
| WH | wh-word phrase | (WH which_DDQ WH) |
| QNT | quantifier phrase | <QNT much_DA1 QNT> |
| ADV | adverb phrase | <ADV still_RR ADV> |
| WHADV | wh-adverb phrase | <WHADV when_RRQ WHADV> |
| ADJ | adjective phrase | <ADJ prone_JJ ADJ> |

The process then divides the input sentence into elements. Chunks are regarded as elements, as are sentence markers, paragraph markers, punctuation marks and words which do not fall inside chunks. Each chunk has a marker applied to it which identifies it as a chunk. These markers constitute chunk markers 99.

The output from the chunking process for the above example sentence is shown in Table 3 below, each line of that table representing an element, and 'phrasetag' representing a chunk marker.

TABLE 3

```
SENTSTART
phrasetag(<ADV) Similarly_RR
'_'
phrasetag((NR) Britain_NP1
phrasetag([VG) became_VVD
phrasetag(<ADJ) popular_JJ
phrasetag[pp after_ICS (NR a_AT1 rumour_NN1 NR) pp]
phrasetag[VG got_VVD about_RP VG]
that_CST
phrasetag(NR Mrs_NNSB1 Thatcher_NP1 NR)
phrasetag[VG had_VHD declared_VVN VG]
phrasetag(NR open_JJ house_NNL1 NR)
SENTEND
._.
```

The computer then carries out classification process 100 under control of the program. The classification process 100 uses a classification of words and pronunciation database 100A. The classification database 100A is the fifth of the five databases stored on the CD-ROM 32.

The classification database is divided into classes which broadly correspond to parts-of-speech. For example, verbs, adverbs and adjectives are classes of words. Punctuation is also treated as a class of words. The classification is hierarchical, so many of the classes of words are themselves divided into sub-classes. The sub-classes contain a number of word categories which correspond to the word tags 95 applied to words in the input text 40 by the parsing process 94. Some of the sub-classes contain only one member, so they are not divided further. Part of the classification (the part relating to verbs, prepositions and punctuation) used in the present embodiment is given in Table 4 below.

TABLE 4

| | | |
|---|---|---|
| verbs | &FW | |
| | BTO22 | |
| | EX | |
| | II22 | |
| | RA | |
| | RGR | |
| | beverbs | VBO VBDR VBG VBM VBN VBR VBZ |
| | doverbs | VDO VDG VDN VDZ |
| | haveverbs | VHO VHG VHN VHZ |
| | auxiliary | VM VM22 VMK |
| | baseform | VVO |
| | presentpart | VVG |
| | past | VBDZ VDD VHD VVD VVN |
| | thirdsingular | VVZ |
| | verbpart | RP |
| prepositions | iopp | IO |
| | iwpp | IW |
| | icspp | ICS |
| | iipp | II |
| | ifpp | IF |
| punctuation | minpunct | comma rhtbrk leftbrk quote ellipsis dash |
| | majpunct | period colon exclam semicol quest |

Figure 4:
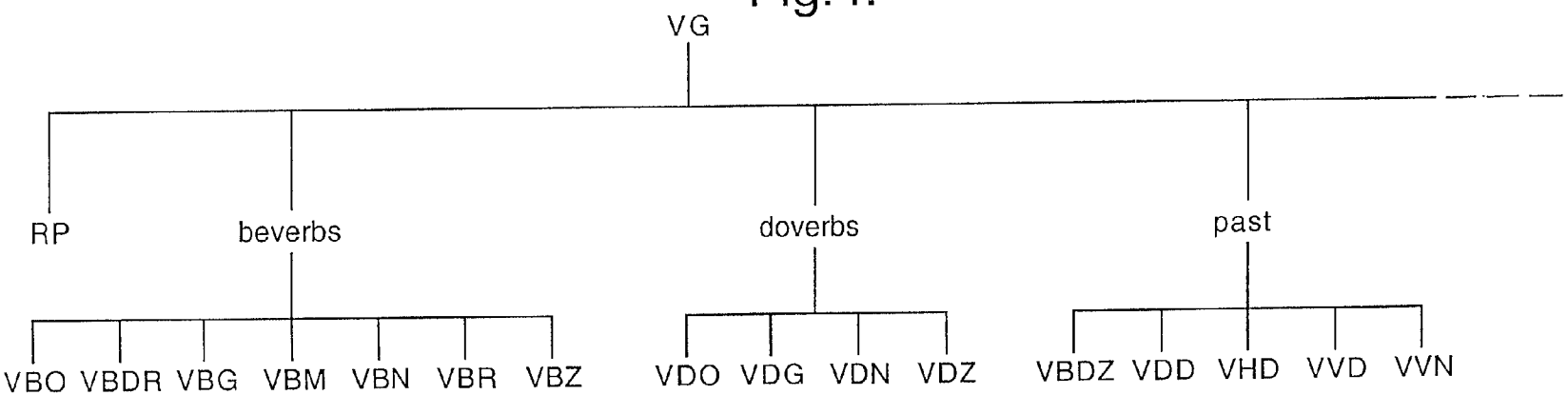
FIG. 4 is a diagram showing part of a syntactic classification of words.

It will be seen that the left-hand column of Table 4 contains the classes, the central column contains the sub-classes and the right-hand column contains the word categories. FIG. 4 shows part of the classification of verbs. The class of words 'verbs' includes four sub-classes, one of which contains only the word category 'RP'. The other sub-classes ('beverbs', 'doverbs', and 'Past') each contain a plurality of word categories. For example, the sub-class 'doverbs' contains the word categories corresponding to the word tags VDO, VDG, VDN, and VDZ.

In carrying out the classification process 100 the computer first identifies a core word contained within each chunk in the input text 40. The core word in a prepositional chunk (i.e. one labelled 'pp' or 'vpp') is the first preposition within the chunk. The core word in a chunk labelled 'WH' or 'WHADV' is the first word in the chunk. In all other types of chunk, the core word is the last word in the chunk. The computer then uses the classification of words 100A to label each chunk with the class, sub-class and word category of the core word.

Each non-chunk word is similarly labelled on the basis of the classification of words 100A, as is each piece of punctuation.

The classifications 101 for the elements generated by the classification process 100 are stored in RAM 12.

Returning again to the example sentence, after classification of the elements of the input sentence would be as shown in Table 5 below

TABLE 5

```
CLASS = [sentstart ]
phrasetag(<ADV) CLASS = [adv ] Similarly_RR
CLASS = [punct minpunct ] ,_,
phrasetag((NR) CLASS = [nonreferent proper ] Britain_NP1
phrasetag([VG) CLASS = [vg past ] became_VVD
phrasetag(<ADJ) CLASS = [adj ] popular_JJ
phrasetag([pp) CLASS = [pp icspp after ] after_ICS
phrasetag ([pp) CLASS = [pp icspp after ] after_ICS
        << SUBCAT phrasetag((NR) CLASS = [nonreferent ] a_AT1
rumour_NN1 >>
phrasetag([VG) CLASS = [vg verbpart] got_VVD about_RP
CLASS = I [lex coords cst ] that_CST
phrasetag(NR CLASS = [nonreferent proper place titular] Mrs_NNSB1
Thatcher_NP1
phrasetag([VG) CLASS = [vg past ] had_VHD declared_VVN
phrasetag(NR CLASS = [nonreferent locative ] open_JJ house_NNL1
NR)
CLASS = [punct majpunct ] ._.
CLASS = [sentend ]
```

It will be seen that each element is labelled with a class and also a sub-class where there are a number of word categories within the sub-class.

Returning to FIG. 2A, as stated above, the syntactic information 48 and word grouping data 46 are stored in the RAM 12 by the text analysis process 42. The syntactic information 48 comprises word tags 95, syntactic groups 96, chunk markers 99 and element classifications 101. The word grouping data comprises the sentence markers 86 and paragraph markers 87.

Similar processing is carried out in forming the prosodic structure corpus 52 stored on the CD-ROM 32. Therefore, each of the reference sentences within the corpus is divided into elements and has similar syntactic information relating to each of the elements contained within it. Furthermore, the corpus contains data indicating where a human would insert prosodic boundaries when reading each of the example sentences. The type of the boundary is also indicated.

An example of the beginning of a sentence that might be found in the corpus 52 is given in Table 6 below. In Table 6, the absence of a boundary is shown by the label 'sfNONE' after an element, the presence of a boundary is shown by 'sfMINOR' or 'sfMAJOR' depending on the strength of the boundary. The start of the example sentence is "As ever, | the American public | and the world's press | are hungry for drama . . . "

TABLE 6

```
CLASS =[sentstart ] sfNONE
phrasetag(<ADV) CLASS = [adv ] As_RG ever_RR sfNONE
```

TABLE 6-continued

```
CLASS = [punct minpunct ] ,__, sfMINOR
phrasetag((NR) CLASS = [nonreferent ] the__AT American__JJ
public__NN sfMINOR
CLASS = [lex coords cc ] and__CC sfNONE
phrasetag((NR) CLASS = [nonreferent ] the__AT world__NN1 's__$
press__NN sfMINOR
phrasetag([VG) CLASS = [vg beverbs ] are__VBR sfNONE
phrasetag( <ADJ) CLASS = [adj ] hungry__JJ sfNONE
phrasetag([pp) CLASS = [pp ifpp for ] for__IF << SUBCAT phrase
tag((NR) CLASS = [nonreferent ] drama__NN1 sfNONE >>
```

The prosodic structure prediction process 50 involves the computer in finding the sequence of elements in the corpus which best matches a search sequence taken from the input sentence. The degree of matching is found in terms of syntactic characteristics of corresponding elements, length of the elements in words and a comparison of boundaries in the reference sentence and those already predicted for the input sentence. The process 50 will now be described in more detail with reference to FIG. 5.

Figure 5:
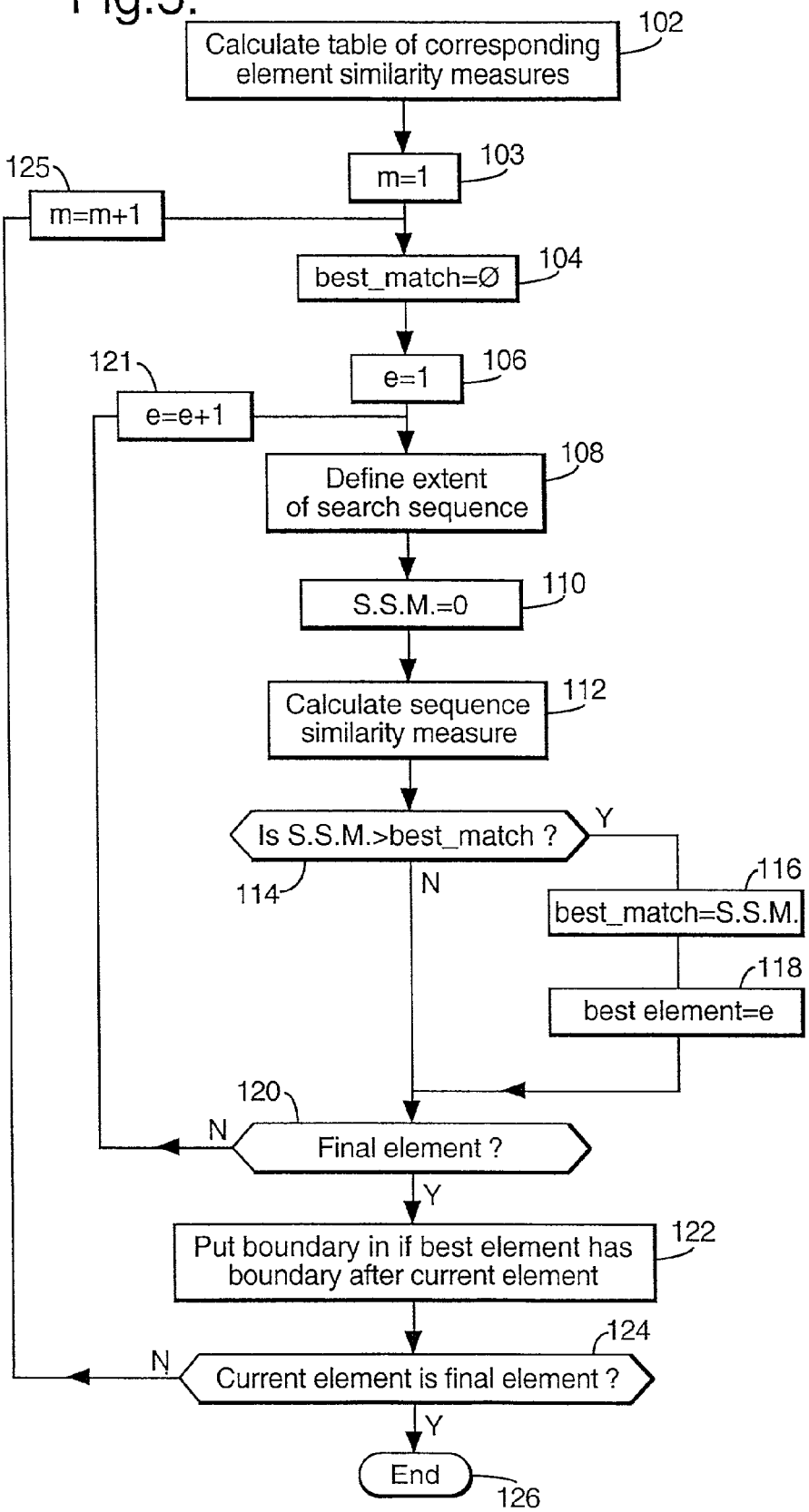
FIG. 5 is a flow chart illustrating the prosodic structure assignment process of FIG. 2B.

FIG. 5 shows that the process 50 begins with the calculation of measures of similarity between each element of the input sentence and each element of the corpus 52. This part of the program is presented in the form of pseudo-code below:

```
FOR each element(ei) of the input sentence:
    FOR each element(er) of the corpus:
        calculate degree of syntactic match between elements ei and er
        (=A)
        calculate no.__of__words match between elements ei and er (=B)
        calculate syntactic match between words in elements ei and er
        (=C)
        match(ei,er) = w1 * A + w2 * B + w3 * C
    NEXT er
NEXT ei
```

where $e_l$ increments from 1 to the number of elements in the input sentence, and $e_r$ increments from 1 to the number of elements in the corpus.

In order to calculate the degree of syntactic match between elements, the program controls the computer to find:

a) whether the core words of the two elements are in the same class; and b) where the two elements are both chunks whether both chunks have the same phrasetag (as seen in Table 2).

A match in both cases might, for example, be given a score of 2, a score of 1 being given for a match in one case, and a score of 0 being given otherwise.

In order to calculate the degree of syntactic match between words in the elements, the program controls the computer to find to what level of the hierarchical classification the corresponding words in the elements are syntactically similar. A match of word categories might be given a score of 5, a match of sub-classes a score of 2 and a match of classes a score of 1. For example, if the reference sentence has [VG is__VBZ argued__VVN VG] and the input sentence has [VG was__VBDZ beaten__VVN VG] then 'is__VBZ' only matches 'was__VBDZ' to the extent that both are classified as verbs. Therefore a score of 1 would be given on the basis of the first word. With regard to the second word, 'beaten__VVN' and 'argued__VVN' fall into identical word categories and hence would be given a score of 5. The two scores are then added to give a total score of 6.

The third component of each element similarity measure is the negative magnitude of the difference in the number of words in the reference element, $e_r$, and the number of words in the element of the input sentence, $e_i$. For example, if an element of the input sentence has one word and an element of the reference sequence has three words, then the third component is −2.

A weighted addition is then performed on the three components to yield an element similarity measure (match ($e_l$, $e_r$) in the above pseudo-code).

Those skilled in the art will thus appreciate that the table calculation step 102 results in the generation of a table giving element similarity measures between every element in the corpus 52 and every element in the input sentence.

Then, in step 103, a subject element counter (m) is initialised to 1. The value of the counter indicates which of the elements of the input sentence is currently subject to a determination of whether it is to be followed by a boundary. Thereafter, the program controls the computer to execute an outermost loop of instructions (steps 104 to 125) repeatedly. Each iteration of the outermost loop of instructions corresponds to a consideration of a different subject element of the input sentence. It will be seen that each execution of the final instruction (step 125) in the outermost loop results in the next iteration of the outermost loop looking at the element in the input sentence which immediately follows the input sentence element considered in the previous iteration. Step 124 ensures that the outermost loop of instructions ends once the last element in the input sentence has been considered.

The outermost loop of instructions (steps 104 to 125) begins with the setting of a best match value to zero (step 104). Also, a current reference element count ($e_r$) is initialised to 1 (step 106).

Within the outermost loop of instructions (steps 104 to 125), the program controls the computer to repeat some or all of an intermediate loop of instructions (steps 108 to 121) as many times as there are elements in the prosodic structure corpus 52. Each iteration of the intermediate loop of instructions (steps 108 to 121) therefore corresponds to a particular subject element in the input sentence (determined by the current iteration of the outermost loop) and a particular reference element in the corpus 52 (determined by the current iteration of the intermediate loop). Steps 120 and 121 ensure that the intermediate loop of instructions (steps 108 to 121) is carried out for every element in the corpus 52 and ends once the final element in the corpus has been considered.

The intermediate loop of instructions (steps 108 to 121) starts by defining (step 108) a search sequence around the subject element of the input sentence.

The start and end of the search sequence are given by the expressions:

$$srch_seq_start = \min(1, m - no_of_elements_before)$$

$$srch_seq_end = \max(no_of_input_sentence_elements, m + no_of_elements_after)$$

In the preferred embodiment, no__of__elements__before is chosen to be 10, and no__of__elements__after is chosen to be 4. It will be realised that the search sequence therefore includes the current element m, up to 10 elements before it and up to 4 elements after it.

In step 110 a sequence similarity measure is reset to zero. In step 112 a measure of the similarity between the search sequence and a sequence of reference elements is calculated. The reference sequence has the current reference element (i.e. that set in the previous execution of step 121) as it core element. The reference sequence contains this core element as well as the four elements that precede it and the ten elements that follow it (i.e. the reference sequence is of the same length as the search sequence). The calculation of the sequence similarity measure involves carrying out first and second innermost loops of instructions. Pseudo-code for the first innermost loop of instructions is given below:

FOR *current_position_in_srch_seq* (=*p*)=
*srch_seq_start* to *srch_seq_end*

*s.s.m*=*s.s.m*+weight(*p*)*match(*srch_element_p*,
*corres_ref_element*) NEXT

Where s.s.m is an abbreviation for sequence similarity measure.

In carrying out the steps represented by the above pseudo-code, in effect, the subject element of the input sentence (set in step 103 or 125) is aligned with the core reference element. Once those elements are aligned, the element similarity measure between each element of the search sequence and the corresponding element in the reference sequence is found. A weighted addition of those element similarity measures is then carried out to obtain a first component of a sequence similarity measure. The measures of the degree of matching are found in the values obtained in step 102. The weight applied to each of the constituent element matching measures generally increases with proximity to the subject element of the input sentence. Those skilled in the art will be able to find suitable values for the weights by trial and error.

The second innermost loop of instructions then supplements the sequence similarity measure by taking into account the extent to which the boundaries (if any) already predicted for the input sentence match the boundaries present in the reference sequence. Only the part of the search sequence before the subject element is considered since no boundaries have yet been predicted for the subject element or the elements which follow it. Pseudo-code for the second innermost loop of instructions is given below:

FOR *current_position_in_srch_seq*(=*q*)=
*srch_seq_start* to m−1

*s.s.m*=*s.s.m*+weight(*q*)**bdymatch*(*srch_element_q*,
*corres_ref_element*) NEXT The boundary matching measure between two elements (expressed in the form bdymatch (element x, element y) in the above pseudo-code) is set to two if both the input sentence and the reference sentence have a boundary of the same type after the qth element, one if they have boundaries of different types, zero if neither has a boundary, minus one if one has a minor boundary and the other has none, and minus two if one has a strong boundary and the other has none. A weighted addition of the boundary matching measures is applied, those inter-element boundaries close to the current element being given a higher weight. The weights are chosen so as to penalise heavily sentences whose boundaries do not match.

It will be realised that the carrying out of the first and second innermost loop of instructions results in the generation of a sequence similarity measure for the subject element of the input sentence and the reference element of the corpus 52. If the sequence similarity measure is the highest yet found for the subject element of the input sentence, then the best match value is updated to equal that measure (step 116) and the number of the associated element is recorded (step 118).

Once the final element has been compared, the computer ascertains whether the core element in the best matching sequence has a boundary after it. If it does, a boundary of a similar type is placed into the input sentence at that position (step 122).

Thereafter a check is made to see whether the current element is now the final element (step 124). If it is, then the prosodic structure prediction process 50 ends (step 126). The boundaries which are placed in the input sentence by the above prosodic boundary prediction process (FIG. 5) constitute the phrase boundary data (FIG. 2A: 54). The remainder of the text-to-speech conversion process has already been described above with reference to FIG. 2B.

In a preferred embodiment of the present invention, boundaries are predicted on the basis of the ten best matching sequences in the prosodic structure corpus. If the majority of those ten sequences feature a boundary after the current element then a boundary is placed after the corresponding element in the input sentence.

In the above-described embodiment pattern matching was carried out which compared an input sentence with sequences in the corpus that included sequences bridging consecutive sentences. Alternative embodiments can be envisaged, where only reference sequences which lie entirely within a sentence are considered. A further constraint can be placed on the pattern matching by only considering reference sequences that have an identical position in the reference sentence to the position of the search sequence in the input sentence. Other search algorithms will occur to those skilled in the art.

The description of the above embodiments describes a text-to-speech program being loaded into the computer from a CD-ROM. It is to be understood that the program could also be loaded into the computer via a computer network such as the Internet.

What is claimed is:

1. A method of converting text to speech said method comprising:

receiving an input word sequence in the form of text;

comparing said input word sequence with each one of a plurality of reference word sequence, said plurality of reference word sequences including prosodic phrase boundary information;

identifying one or more reference word sequences which most closely match said input word sequence; and predicting prosodic phrase boundaries for a synthesized spoken version of the input text on the basis of the prosodic phrase boundary information included with said one or more most closely matching reference word sequences.

2. A method as in claim 1 further comprising:

identifying clusters of words in the input word sequence which are unlikely to include prosodic phrase boundaries;

wherein:

said plurality of reference word sequences are further provided with information identifying such clusters of words therein; and said comparison step comprises a plurality of per-cluster comparisons.

3. A method as in claim 2 wherein said per-cluster comparison comprises quantifying the degree of similarity between the syntactic characteristics of the clusters.

4. A method as in claim 2 wherein said per-cluster comparison comprises quantifying the degree of similarity between the syntactic characteristics of the words within the clusters.

5. A method as in claim 2 wherein said per-cluster comparison comprises measuring the difference in the number of words in the clusters being compared.

6. A method as in claim 1 wherein said comparison comprises measuring the similarity in the positions of prosodic phrase boundaries previously predicted for the input word sequence and the positions of the prosodic phrase boundaries in the reference word sequences.

7. A program storage device readable by a computer, said device embodying computer readable code executable by the computer to perform method steps according to claim 1.

8. A signal embodying computer executable code for loading into a computer for the performance of a method according to claim 1.

9. A text to speech conversion apparatus comprising:

a word sequence store storing a plurality of reference word sequence, said plurality of reference word sequences including prosodic phrase boundary information;

a program store storing a program;

a processor in communication with said program store and said word sequence store;

means for receiving an input word sequence in the form of text;

wherein said program is executable to control said processor to:

compare said input word sequence with each one of a plurality of said reference word sequences;

identify one or more reference word sequences which most closely match said input word sequence; and derive prosodic phrase boundary information for the input text on the basis of the prosodic phrase boundary information included with said one or more most closely matching reference word sequences.

10. A text to speech conversion apparatus comprising:

receiving means arranged in operation to receive an input word sequence in the form of text;

a word sequence store storing a plurality of reference word sequences, said plurality of reference word sequences including prosodic phrase boundary information;

comparison means arranged in operation to compare said input text with each one of a plurality of said reference word sequences;

identification means arranged in operation to identify one or more reference word sequences which most closely match said input word sequence; and prosodic phrase boundary prediction means arranged in operation to predict prosodic phrase boundaries for the input text on the basis of the prosodic phrase boundary information included with said one or more most closely matching reference word sequences.

* * * * *